US007662246B2

(12) United States Patent
Zand et al.

(10) Patent No.: US 7,662,246 B2
(45) Date of Patent: Feb. 16, 2010

(54) STEEL FOR COMPONENTS OF CHEMICAL INSTALLATIONS

(75) Inventors: Johann Zand, Kapfenberg (AT); Johannes Schedelmaier, Kapfenberg (AT); Manfred Pölzl, Feistritz bei Knittelfeld (AT)

(73) Assignees: Boehler Hochdrucktechnik GmbH, Kapfenberg (AT); Boehler Edelstahl GmbH, Kapfenberg (AT)

( * ) Notice: Subject to any disclaimer, the term of this patent is extended or adjusted under 35 U.S.C. 154(b) by 803 days.

(21) Appl. No.: 10/981,526

(22) Filed: Nov. 5, 2004

(65) Prior Publication Data

US 2005/0169790 A1 Aug. 4, 2005

(30) Foreign Application Priority Data

Nov. 7, 2003 (AT) ..... A 1783/2003

(51) Int. Cl.
*C22C 38/44* (2006.01)
*C22C 38/46* (2006.01)

(52) U.S. Cl. ..... 148/335; 420/108; 420/109

(58) Field of Classification Search ..... 148/320, 148/335; 420/108–109, 84
See application file for complete search history.

(56) References Cited

U.S. PATENT DOCUMENTS 5,225,156 A 7/1993 Ototani
5,458,704 A 10/1995 Bobbert et al. ..... 420/103
5,746,843 A * 5/1998 Miyata et al. ..... 148/335

FOREIGN PATENT DOCUMENTS

EP 0580062 1/1994
EP 1127951 8/2001
JP 59-129724 7/1984
JP 401179896 * 7/1989
JP 03-232946 * 10/1991
JP 08-120400 * 5/1996

OTHER PUBLICATIONS

English translation of Japanese patent 01-179896, Hiroyuki Doi et al., Jul. 17, 1989.*

Metals Handbook, Second Desk Edition, ASM International, 1998, "Carbon and Alloy Steels" 220-221.*

Böhler Hochdrucktechnik, "Bars for Ultra High Pressure pipes from DIN 1.6952", Aug. 30, 1999.

Stamicarbon bv "Chemical 53 Plant—Ultra-HSLA VAR/ESR material for tubular reactor application", A4 72767, Nov. 2002/Feb. 2003.

Stamicarbon bv "Chemical 53 Plant—Low alloy forging steel 26NiCrMo 14.6", A4 71434, Jan. 2001.

Azuma T., et al. "Production and Properties of Superclean 3.5% NiCrMoV Rotor Forging for Low Pressure Steam Turbine", Proceedings of the Robert I. Jaffee Memorial Symposium on Clean Materials Technology, ASM Materials Week, Chicago, Illinois, USA, Nov. 2-5, 1992, pp. 213-220.

(Continued)

*Primary Examiner*—Deborah Yee
(74) *Attorney, Agent, or Firm*—Greenblum & Bernstein, P.L.C.

(57) ABSTRACT

An iron-based alloy for use in a material for high-pressure components. This Abstract is not intended to define the invention disclosed in the specification, nor intended to limit the scope of the invention in any way.

33 Claims, 2 Drawing Sheets

OTHER PUBLICATIONS

Honeyman G.A., et al. "Temper Embrittlement in High Strength Pressure Vessel Steels for Polyethylene Manufacture", pp. 243-253, accompanied by a printout from the Internet allegedly showing this article to be from Clean Steel: Superclean Steel; Conference proceedings Mar. 6-7, 1995, London, UK, 1996, editors: Nutting J., Viswanathan, R., Institute of Materials.

Analysis sheets (E1-E8) relating to steels allegedly sold in Germany in Jul. and Aug. 2003 by the company BGH Edelstahl Siegen GmbH, Siegen, Germany, to the company Uhde High Pressure Technologies GmbH, Hagen, Germany.

Böhler Edelstahl Handbuch (Böhler Stainless Steel Handbook), Böhler Edelstahl GmbH & Co KG, Kapfenberg Austria, 1998 (AL 005 D—07.98—1000 N), pp. 446-454, 468-473.

P.A. Bralsford, E. Hydes, G.A. Honeyman: "Residual contents in purchased scrap for use in basic electric arc technology" Clean Steel: Superclean Steel, Conference Proceedings, 1996, pp. 53-58, XP002427800, Londo.

R. Viswanathan: "Application of clean steel/superclean steel technology inThe electric power industry—overview of EPRI research and products" Clean Steel: Superclean Steel, Conference Proceedings, 1996, pp. 1-31, XP002427801, London.

L.E.K. Holappa, A.S. Helle: "Inclusion control in high performance steels"Journal of Materials Processing Technology, Nr. 53, 1995, pp. 177-186, XP002427802, London.

English language Abstract of JP 59-129724.

* cited by examiner

STEEL FOR COMPONENTS OF CHEMICAL INSTALLATIONS

CROSS-REFERENCE TO RELATED APPLICATIONS

The present invention claims priority under 35 U.S.C. § 119 of Austrian Patent Application No. A 1783/2003, filed Nov. 7, 2003, the disclosure of which is expressly incorporated by reference herein in its entirety.

BACKGROUND OF THE INVENTION

1. Field of the Invention

The present invention relates to an iron-based alloy for use as a material for high-pressure components with increased working temperature. In particular, it relates to A heat-treatable steel for components such as tube heat exchangers in polyethylene high-pressure installations. This steel comprises the following main alloying elements in % by weight:

| | |
|---|---|
| Carbon (C) | 0.22 to 0.29 |
| Chromium (Cr) | 1.1 to 1.5 |
| Molybdenum (Mo) | 0.3 to 0.6 |
| Nickel (Ni) | 3.3 to 3.7 |
| optionally, Vanadium (V) | 0.05 to 0.15 |
| the balance being iron (Fe). | |

The still further comprises sulfide-forming and oxide-forming elements as well as accompanying and impurity elements. Furthermore, the invention relates to a component with increased working temperature, in particular a tube heat exchanger for polyethylene high-pressure installations made of an above-mentioned iron-based alloy.

2. Discussion of Background Information

Iron-based alloys according to DIN material no. 1.6604 or material no. 1.6580 or material no. 1.6586 and material no. 1.6926 or material no. 1.6944 and material no. 1.6952 are mostly used as materials for components that have to withstand high mechanical stresses at elevated temperatures, e.g., at 300° to 400° C., such as tube heat exchangers of chemical installations with an internal pressure of about 3,000 bar and higher. To establish the desired material strength, the parts are austenitized and hardened from the austenitizing temperature at a high cooling rate or quenched and then tempered, a stress-relieving treatment at temperatures up to the tempering temperature often following this heat treatment of the material.

A heat treatment by hardening and tempering for increasing the tensile strength of the material has a considerable impact also on other mechanical properties of the material at room temperature and at elevated working temperatures. An increase in the tensile strength above a value of about 1000 $N/mm^2$ to about 1100 $N/mm^2$ and higher disproportionally increases the 0.2% yield point of the iron-based material, whereby a ratio that is characteristic of the safety of the operation of high-pressure installations, i.e., the ratio of the 0.2% yield point ($Rp_{0.2}$) and the tensile strength (Rm) is adversely influenced. In other words, the yield point approaches the tensile strength, with the elongation at break and the notch impact strength of the material being considerably reduced and the tear fracture toughness being substantially lowered.

For reasons of operating safety of high-pressure components, in particular that of installations of the chemical industry, the above-mentioned materials are heat-treated only up to the strength at which the associated elongation and toughness properties of the material are deemed to be sufficient or meet the regulations. A disadvantage in terms of installation engineering is that a great wall thickness of the high-pressure components is thus necessary, and there may also be an influence on reaction kinetics of the chemical materials and a low cost-effectiveness of the reactor or the installation. If, e.g., high-pressure heat exchangers are designed to establish sufficiently high elongation and toughness values of the material with the necessary strength of the same, the wall thickness has to be given large dimensions according to the stress, which is associated with a low specific heat transmission, which necessitates large thick-walled reactors.

A difficulty associated with thick-walled tubes is meeting the so-called "leak prior to fracture" criterion that always has to be met in high-pressure technology for safety reasons. In other words, if in the operation of a reactor a crack grows in the tube wall, this crack first has to reach the outer surface (=leak), before an unstable fracture occurs. The critical fracture toughnesses, such as $K_{1c}$ or $J_{1c}$ or the critical crack length $a_c$ are characteristic values of an unstable fracture. These material-specific characteristic values depend primarily on the toughness of the material.

It is desirable to overcome the above deficiencies. In particular, it would be advantageous to provide an iron-based alloy of the type mentioned at the outset for use in high-pressure components with increased strength at high elongation and toughness values of the material.

It would also be advantageous to provide a component, in particular, a tube heat exchanger for polyethylene high-pressure installations, with improved performance characteristics and/or similar safety criteria, which component is made of an above-mentioned iron-based material with high strength and at the same time favorable elongation and toughness values.

SUMMARY OF THE INVENTION

The present invention provides an iron-based alloy for use in a material for high-pressure components. This alloy comprises, in percent by weight:

| | |
|---|---|
| C | from about 0.22 to about 0.29 |
| Cr | from about 1.1 to about 1.5 |
| Mo | from about 0.3 to about 0.6 |
| Ni | from about 3.3 to about 3.7 |
| V | from 0 to about 0.15 |
| Mn | from about 0.15 to about 0.5 |
| (Co + Cu + W) | up to about 0.31 |
| S | up to about 0.003 |
| P | up to about 0.005 |
| (S + P) | up to about 0.006 |
| O | up to about 0.0038 |
| Si | from about 0.1 to about 0.25 |
| Al | from about 0.005 to about 0.02 |
| Ca | from about 0.0001 to about 0.0008 |
| Mg | from about 0.0001 to about 0.0006 |
| (Ti + Nb + Ta + Zr + Hf) | up to about 0.01 |
| (As + Bi + Sb + Sn + Zn + B) | up to about 0.015 |
| (N + H) | up to about 0.01, |
| the balance comprising iron. | |

Unless indicated otherwise, the weight percentages given in the present specification and in the appended claims are based on the total weight of the alloy.

In one aspect, the alloy may comprise at least about 0.05 weight percent of vanadium.

In another aspect, the alloy may comprise not more than about 0.008 weight percent of the sum (N+H). In yet another aspect, the alloy of the present invention may comprise not more than about 0.001 weight percent of N.

In a still further aspect, the alloy may comprise one or more of the elements in the following weight percentages:

| | |
|---|---|
| Mn | up to about 0.4 |
| (Co + Cu + W) | up to about 0.24 |
| S | up to about 0.0008 |
| (S + P) | up to about 0.005 |
| O | up to about 0.0011 |
| Si | up to about 0.20 |
| Al | at least about 0.008 |
| Al | up to about 0.018 |
| (Ti + Nb + Ta + Zr + Hf) | at least about 0.001 |
| (Ti + Nb + Ta + Zr + Hf) | up to about 0.008 |
| (As + Bi + Sb + Sn + Zn + B) | up to about 0.010 |
| (N + H) | up to about 0.008. |

For example, the alloy of the present invention may comprise, in percent by weight:

| | |
|---|---|
| Mn | from about 0.15 to about 0.4 |
| (Co + Cu + W) | up to about 0.24 |
| S | up to about 0.0008 |
| (S + P) | up to about 0.005 |
| O | up to about 0.0011 |
| Si | from about 0.1 to about 0.20 |
| Al | from about 0.008 to about 0.018 |
| (Ti + Nb + Ta + Zr + Hf) | from about 0.001 to about 0.008 |
| (As + Bi + Sb + Sn + Zn + B) | up to about 0.010 |
| (N + H) | up to about 0.008. |

In another aspect, the alloy may be produced by a ladle steelmaking process and/or by an electroslag remelting process and/or by a vacuum arc furnace process.

The present invention also provides a material for use in high-pressure components. This material comprises the alloy of the present invention, including the various aspects thereof.

In one aspect, the material may exhibit an amount of forming that is greater than about 4.1-fold.

In another aspect, a component or part made from the material may have substantially isotropic mechanical properties and/or a high strength and toughness at a working temperature of up to about 350° C.

In yet another aspect, the component or part may comprise the material of the present invention and may be heat treated to a tensile strength Rm of the material at room temperature of greater than about 1100 N/mm$^2$, and may have a 0.2% yield point $Rp_{0.2}$ at room temperature of greater than about 1000 N/mm$^2$ and a 0.2% yield point $Rp_{0.2}$ at 320° C. of greater than about 880 N/mm$^2$. For example, the component or part may be heat treated to a tensile strength Rm of the material at room temperature of greater than about 1170 N/MM$^2$, and may have a 0.2% yield point $Rp_{0.2}$ at room temperature of greater than about 1060 N/mm$^2$ and a 0.2% yield point $Rp_{0.2}$ at 320° C. of greater than about 920 N/mm$^2$.

In a still further aspect, the component or part may show mechanical properties measured in longitudinal direction/transverse direction of:

| | |
|---|---|
| Elongation at break A5 | >about 16%/>about 14%, for example, >about 15%/>about 14% |
| Elongation at break A4 | >about 18%/>about 16%, for example, >about 17%/>about 16% |
| Reduction in area Z | >about 55%/>about 45%, |

-continued

| | |
|---|---|
| Notch toughness KV (RT) | >about 80 J/>about 60 J |
| Notch toughness KV (−40° C.) | >about 50 J/>about 40 J, for example, >about 50 J/>about 35 J. |

In yet another aspect of the component or part, the ratio $Rp_{0.2}$/Rm may be smaller than about 0.94, for example, smaller than about 0.92.

In a still further aspect of the component or part, the fracture toughness of the material $J_{1C}$ may be greater than about 150 kJ/m$^2$.

The present invention also provides a tube heat exchanger for high-pressure installations. The exchanger comprises the component or part set forth above, including the various aspects thereof.

In one aspect, the heat exchanger may be capable of withstanding an internal pressure of at least about 3,000 bar.

The present invention also provides a component or part which comprises a material that comprises an alloy. The alloy comprises, in percent by weight:

| | |
|---|---|
| C | from about 0.22 to about 0.29 |
| Cr | from about 1.1 to about 1.5 |
| Mo | from about 0.3 to about 0.6 |
| Ni | from about 3.3 to about 3.7 |
| V | from 0 to about 0.15 |
| Mn | from about 0.15 to about 0.4 |
| (Co + Cu + W) | up to about 0.24 |
| S | up to about 0.0008 |
| P | up to about 0.005 |
| (S + P) | up to about 0.005 |
| O | up to about 0.0011 |
| Si | from about 0.1 to about 0.20 |
| Al | from about 0.008 to about 0.018 |
| Ca | from about 0.0001 to about 0.0005 |
| Mg | from about 0.0001 to about 0.0005 |
| (Ti + Nb + Ta + Zr + Hf) | from about 0.001 to about 0.008 |
| (As + Bi + Sb + Sn + Zn + B) | up to about 0.010 |
| (N + H) | up to about 0.008, |
| the balance being iron. | |

This material exhibits an amount of forming of greater than about 4.1-fold. Also, the component or part is heat treated to a tensile strength Rm of the material at room temperature of greater than about 1170 N/mm$^2$, and has a 0.2% yield point $Rp_{0.2}$ at room temperature of greater than about 1060 N/mm$^2$ and a 0.2% yield point $Rp_{0.2}$ at 320° C. of greater than about 920 N/mm$^2$. The ratio $Rp_{0.2}$/Rm is smaller than about 0.92 and the fracture toughness of the material $J_{1C}$ is greater than about 150 kJ/m$^2$.

Further, the component or part shows mechanical properties measured in longitudinal direction/transverse direction of:

| | |
|---|---|
| Elongation at break A5 | >about 15%/>about 14% |
| Elongation at break A4 | >about 17%/>about 16% |
| Reduction in area Z | >about 55%/>about 45% |
| Notch toughness KV (RT) | >about 80 J/>about 60 J |
| Notch toughness KV (−40° C.) | >about 50 J/>about 35 J. |

The present invention also provides a tube component which capable of withstanding high internal pressure. In this tube, the actual stress intensity factor of the tube wall material is lower than the critical stress intensity factor of the material, i.e., the tube meets the "leak prior to fracture" criterion.

In the iron-based alloy of the present invention, the sulfide-forming and oxide-forming and accompanying elements and impurity elements thereof exhibit the following individual concentrations and/or total contents for groups of elements that act in the same way in % by weight:

| | |
|---|---|
| elements that can be incorporated in the solid solution: | |
| manganese (Mn) | from about 0.15 to about 0.5 |
| (Co + Cu + W) | up to about 0.31 |
| impurity elements | |
| sulfur (S) | up to about 0.003 |
| phosphorus (P) | up to about 0.005 |
| (P + S) | up to about 0.006 |
| oxygen (O) | up to about 0.0038 |
| oxide-forming elements | |
| silicon (Si) | from about 0.10 to about 0.25 |
| aluminum (Al) | from about 0.008 to about 0.02 |
| calcium (Ca) | from about 0.0001 to about 0.0008 |
| magnesium (Mg) | from about 0.0001 to about 0.0006 |
| monocarbide-forming elements | |
| (Ti + Nb + Ta + Zr + Hf) | up to about 0.01 |
| grain boundary coating elements | |
| (As + Bi + Sb + Sn + Zn + B) | up to about 0.015 |
| Gases | |
| Nitrogen (N) | up to about 0.001 |
| (N + H) | up to about 0.01 |
| preferably, | up to about 0.008 |

The material of the alloy exhibits an amount of forming of greater than about 4.1-fold, and the components or parts made therefrom after a heat treatment thereof have largely isotropic mechanical properties and high strength and toughness values at a working temperature of up to 350° C.

Advantages achieved with the invention will usually include that through an adjustment or a maximization of contents of certain elements and/or element groups in the material, a microstructural production is rendered possible through a heat treatment which provides a high material strength as well as a substantially improved toughness and more favorable elongation values.

Property values of an alloy material can be influenced and some can often be improved with a decreasing concentration of the impurity elements of the alloy. However, highly pure alloys tend to form coarse grains during a heat treatment, which can have an adverse effect on certain material values.

It was surprisingly found that in terms of alloy technology an advantageous microstructure can be achieved after a thermal treatment of the steel according to the invention by reducing or fixing the concentrations of some elements or groups of elements, which results in comparatively substantially improved elongation, contraction and toughness values of the material, even with a high hardness of the material. These sharp improvements have not yet been fully explained in scientific terms. Without wanting to be bound by any theory, it is assumed that these discontinuous property changes can be attributed to the avoidance of tempering embrittlement phenomena and/or the elimination of a grain boundary coating during a stress relieving of the part or component at elevated temperatures.

The role of the elements present in the alloy according to the invention will be explained below in more detail, where the main alloying elements are coordinated with one another in terms of kinetic effect with respect to a heat treatment.

Carbon dissolves during heating in the austenitic region of the alloy in the solid state and during quenching carbon causes a tightening of the crystal lattice and thus, a hardening of the material. Carbon contents of at least about 0.22% by weight are desirable in the alloy according to the invention in order to achieve a material hardness of at least about 1100 $N/mm^2$ during a heat treatment. If the carbon concentration exceeds about 0.29% by weight, an increased concentration of stable carbides in the material and reduced toughness values of the material may result.

Depending on the concentrations of the elements, chromium essentially forms carbides $Cr_{23}C_6$, $Cr_7C_3$ and $Cr_3C_2$ and influences to a great extent the hardening criteria of the material. In order to obtain a desired property profile of the material, at least about 1.1%, but not more than about 1.5% by weight of Cr is favorable for a desired carbide and mixed carbide formation.

Molybdenum has a reducing effect on a tempering embrittlement, is a stronger carbide former than chromium and iron and synchronized with Cr should desirably be present in the steel with a content of at least about 0.3% by weight in order to exert a corresponding hardness-increasing effect during a heat treatment of the part. Advantageously fine Mo carbides and mixed carbides are precipitated during tempering up to a Mo content of about 0.6% by weight, which promotes the ductility of the material at a high hardness of the material.

Nickel essentially influences the hardenability of the material and of promotes the toughness of the material. Nickel contents of lower than about 3.3% by weight will usually not be very effective, whereas nickel concentrations of higher than about 3.7% by weight may afford an excessive austenite-stabilizing effect.

Preferably, vanadium is provided in the material in concentrations of from about 0.05% to about 0.15% by weight. As a very strong carbide former, V has a grain-refining effect as a micro-alloying element, and increases the material hardness during tempering after hardening in the temperature range between about 450° C. and about 560° C. through extremely fine secondary carbide precipitates. Higher contents than about 0.15% by weight of V may sometimes have an undesired impact on the hardenability and may reduce the toughness of the material.

In addition to the main alloying elements, the iron-based alloy according to the present invention comprises a balance of iron and accompanying and impurity elements.

One group of these accompanying and impurity elements comprises the elements Mn, Co, Cu and W, which elements are incorporated in the solid solution.

Manganese has an effect on the hardenability of the steel, binds the residual sulfur content and is advantageously provided in the steel in a concentration range of from about 0.15% to about 0.5% by weight. Lower contents may cause the sulfur activity to be too low, which increases the risk of fracture and may have an adverse effect on the property profile. Although Co, Cu and W are elements that can be present in certain contents incorporated in the solid solution, a total concentration thereof of higher than about 0.31% by weight may have an significant adverse effect on the ratio $$\frac{Rp_{0.2}}{Rm}$$

At a given high tensile strength, the value for the 0.2% yield point of the material often sharply increases with a total content of (Co+Cu+W) of greater than about 0.31, whereby a ratio value of higher than 0.95 may disadvantageously be established.

With decreasing contents, the impurity elements sulfur and phosphorus lead to an improvement of the mechanical properties of the material, but, in view of the required extremely high property profile of the heat-treated material, their concentrations should desirably not exceed values of about 0.003% by weight of S and about 0.005% by weight of P, and the total concentration thereof preferably does not exceed about 0.006% by weight.

Dissolved oxygen in the steel is bound by oxide-forming elements, with oxide inclusions being formed that impair the properties of the material, in particular toughness and elongation. Even through remelting processes the oxidation products cannot be completely eliminated from the alloy, so that the oxygen content in the alloy should usually not be higher than about 0.0038% by weight.

In order to obtain good further property values with a provided smelting, processing and heat-treatment of the material to the highest hardness, it is desirable to adjust the oxide-forming elements to the provided contents in order on the one hand to obtain a complete deoxidation with the formation of favorable mixed oxides in the most finely distributed form and on the other hand, to definitely eliminate a grain boundary coating that can cause a sharp reduction in toughness. In this regard, the total concentration of Ca plus Mg is preferably not higher than about 0.008% by weight.

Taking into account the favorable effect of V, it is surprising that the other monocarbide-forming elements Ti, Nb, Zr and Hf consistently have an adverse effect on the toughness and susceptibility to brittle fractures of a material that is heat-treated to high strength values. Accordingly, the total concentration of these elements in the alloy of the present invention desirably does not exceed about 0.01% by weight.

If, as is provided according to the invention, the grain boundary coating elements As, Bi, Sb, Sn, Zn and B are present in the alloy in a total concentration of not more than about 0.015% by weight, there is an adequate extent of ductility of the heat-treated material even at high hardness values of the same. However, exceeding this recommended total concentration promotes a tendency to brittle fracture without deformation.

Although the strong nitride formers in the alloy according to the invention are present in low concentrations, a total concentration of (N+H) of not higher than about 0.01% by weight, advantageously not higher than about 0.008% by weight, is desirable in order to be able to achieve a desired property level of the material.

If the material is hot-worked by forging or rolling and exhibits an amount of forming of greater than 4.1-fold, after a heat treatment of the part, in particular of a rod or a tube, high strength values and thereby considerably improved toughness properties can be achieved at a working temperature of about 350° C.

A further increase of the achievable property level of parts and components can be achieved by using an alloy according to the invention that exhibits one or more of the following individual concentrations and total contents of the elements in % by weight:

| | |
|---|---|
| Mn | from about 0.15 to about 0.4 |
| (Co + Cu + W) | up to about 0.24 |
| S | up to about 0.0008 |
| (S + P) | up to about 0.005 |

-continued

| | |
|---|---|
| O | up to about 0.0011 |
| Si | from about 0.1 to about 0.20 |
| Al | from about 0.005 to about 0.018 |
| (Ti + Nb + Ta + Zr + Hf) | from about 0.001 to about 0.008 |
| (As + Bi + Sb + Sn + Zn + B) | up to about 0.010 |
| (N + H) | up to about 0.008. |

Advantageously, the alloy is produced by means of ladle steelmaking methods and/or using the electroslag remelting process (ESU) and/or the vacuum arc furnace process (VLBO), because these processes minimize a segregation in the ingot and thus, create the prerequisite for substantially identical material properties in the longitudinal and transverse directions of the part.

With a component, in particular a tube heat exchanger for polyethylene high-pressure installations, made of an iron-based alloy with a composition according to the data provided above, the component will be capable of exhibiting a tensile strength Rm of the material of greater than about 1100 N/mm$^2$ and of having a 0.2% yield point at 320° C. of greater than about 880 N/mm$^2$.

By utilizing the high material strength provided by the present invention, the wall thickness of the high-pressure components can be reduced because the 0.2% yield points at room temperature and at a working temperature of 320° C. show a substantial distance from the strength value, whereby a high protection of the component from brittle fracture is provided. Thinner wall thicknesses, e.g., of a heat exchanger, result in a higher specific heat transmission so that the reactor achieves the same capacity with a much smaller size or the reactor has a higher capacity at the same size. The "leak prior to fracture" criterion is particularly important here.

According to the present invention, the following mechanical property values, measured in the direction of the longitudinal extension/transverse to the longitudinal extension of the component may be achieved:

| | |
|---|---|
| Elongation at break A5 | >about 16%/>about 14% |
| Elongation at break A4 | >about 18%/>about 16% |
| Reduction in area Z | >about 55%/>about 45% |
| Notch toughness KV (RT) | >about 80 J/>about 60 J |
| Notch toughness KV (−40° C.) | >about 50 J/>about 40 J. |

If the component, in particular a tube heat exchanger for polyethylene high-pressure installations, is heat-treated to a tensile strength Rm of the material of greater than about 1170 N/mm$^2$, it will usually have a 0.2% yield point of greater than about 1060 N/mm$^2$ and a 0.2% yield point at 320° C. of greater than about 930 N/mm$^2$, which makes possible a further reduction of the wall thickness of high-pressure components, which may result in substantial advantages in terms of installation engineering as well as reaction kinetics.

According to the invention, the mechanical property values of this above-mentioned material with higher strength values measured in the direction of the longitudinal extension and transverse to the longitudinal extension of the component include:

| | |
|---|---|
| Elongation at break A5 | >about 15%/>about 14% |
| Elongation at break A4 | >about 17%/>about 16% |
| Reduction in area Z | >about 55%/>about 45% |

-continued

| | |
|---|---|
| Notch toughness KV (RT) | >about 80 J/>about 60 J |
| Notch toughness KV (−40° C.) | >about 50 J/>about 35 J. |

A5 and A4 represent the sample length used, i.e., 5 times the sample diameter and 4 times the sample diameter, respectively. KV refers to a test with a V-shaped notch.

Particularly high protection from failure, in particular from the occurrence of a brittle fracture, is achieved with a value of the 0.2% yield point divided by the tensile strength of less than about 0.94, preferably less than about 0.92.

According to the present invention it is preferred for the component to have a tear fracture toughness $J_{1C}$ of the material of greater than about 150 kJ/m$^2$, measured according to ASTM-E813.

It is noted that the parameters Rm, $Rp_{0.2}$, Z, KV, A4 and A5 as used herein and in the appended claims are defined as, and their values determined according to the methods disclosed in BÖHLER EDELSTAHL HANDBUCH (BÖHLER STAINLESS STEEL HANDBOOK), Böhler Edelstahl GmbH & Co KG, Kapfenberg, Austria, 1998 (AL 005 D-07.98-1000 N), pp. 446-454, 468-473, the entire disclosure whereof is expressly incorporated by reference herein.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Table 1 lists the chemical composition of two materials according to the invention. The melts were treated by ladle steelmaking and each melt was cast to form electrodes. The ingot of charge H 75142 was remelted in a vacuum arc furnace and further formed 5.85-fold in a long forging machine to form a rod having a diameter of 200 mm, from which rod tubes were produced for a heat exchanger of a polyethylene reactor. The heat treatment of the tube material was conducted to a strength Rm of about 1,250 MPa.

The ingot of charge G 53227 was produced according to the electroslag remelting method. The further processing to form a heat exchanger was carried out in the same manner as with the vacuum arc furnace ingot.

Figure 1:
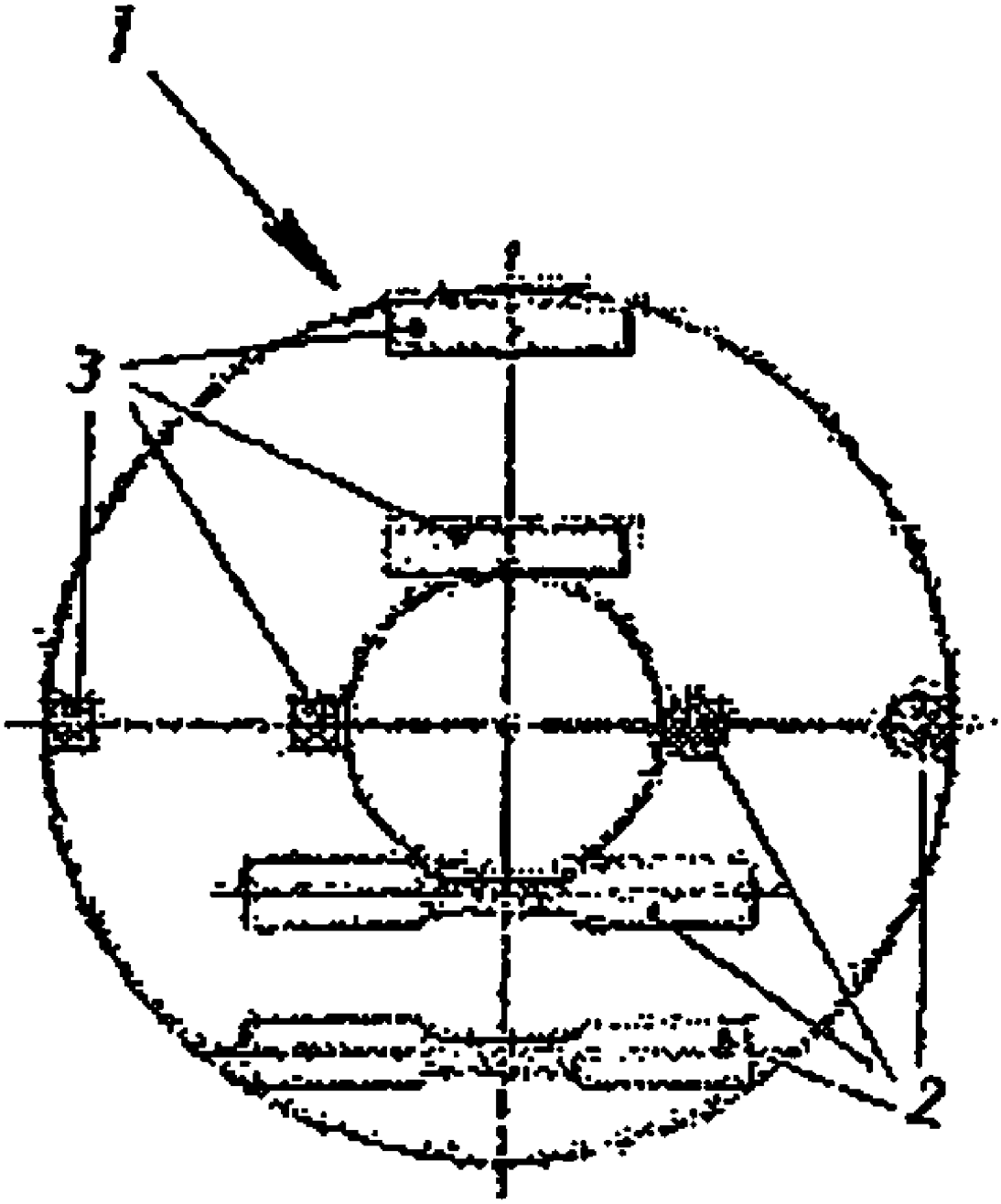
FIG. 1 shows the locations in the cross-section of a processed rod according to the present invention from which samples were taken for testing.

FIG. 1 shows the locations of the processed rod 1 with a diameter of 190 mm from which the samples were taken. The numerals represent the following: 2=tensile samples, 3=notched impact samples.

Table 2 gives the measured mechanical characteristic values of the material from the rod material.

ZVF stands for tensile test with fine elongation measurement, ZVW stands for tensile test in a heated state at 320° C. KR refers to a notched impact toughness test at room temperature, KK designates notched impact toughness values at reduced temperature, in this case −23° C. In order to take into account the high safety requirements, the notched impact toughness of the material was tested with three samples.

A5 represents the sample length used, i.e., 5 times the sample diameter.

TABLE 1

| Chemical Elements | H75142 | G53227 |
|---|---|---|
| C | 0.25 | 0.23 |
| Cr | 1.27 | 1.37 |
| Mo | 0.43 | 0.43 |
| Ni | 3.43 | 3.42 |
| V | 0.10 | 0.093 |
| Mn | 0.31 | 0.32 |
| Co | 0.05 | 0.02 |
| Cu | 0.02 | 0.02 |
| W | 0.02 | 0.05 |
| Co + Cu + W | 0.09 | 0.09 |
| S | 0.0005 | 0.0006 |
| P | 0.003 | 0.003 |
| S + P | 0.0035 | 0.0036 |
| O | 0.0009 | 0.0011 |
| Si | 0.19 | 0.18 |
| Al | 0.014 | 0.011 |
| Ca | 0.0002 | 0.0002 |
| Mg | 0.0002 | 0.0002 |
| Ca + Mg | 0.0004 | 0.0004 |
| Ti | 0.001 | 0.001 |
| Nb | 0.001 | 0.001 |
| Ta | 0.002 | 0.002 |
| Zr | 0.002 | 0.002 |
| Hf | — | — |
| Ti + Nb + Ta + Zr + Hf | 0.006 | 0.006 |
| As | 0.0032 | 0.0029 |
| Bi | 0.0005 | 0.0005 |
| Sb | 0.0005 | 0.0007 |
| Sn | 0.004 | 0.0036 |
| Zn | 0.0005 | 0.0017 |
| B | 0.0005 | 0.0005 |
| As + Bi + Sb + Sn + Zn + B | 0.0092 | 0.0099 |
| N | 0.0045 | 0.0081 |
| H | 0.00005 | 0.00008 |
| N + H | 0.00455 | 0.00818 |

TABLE 2

| | Electroslag Remelting G53227 | Vacuum Arc Furnace H75142 |
|---|---|---|
| ZVF-outside/longitudinal | | |
| $Rp_{0.2}$ [MPa] | 1,157 | 1,158 |
| Rm [MPa] | 1,258 | 1,267 |
| $Rp_{0.2}$/Rm | 0.920 | 0.914 |
| A5 [%] | 16 | 17 |
| Z [%] | 63 | 66 |
| ZVF-inside/longitudinal | | |
| $Rp_{0.2}$ [MPa] | 1,159 | 1,190 |
| Rm [MPa] | 1,259 | 1,284 |
| $Rp_{0.2}$/Rm | 0.921 | 0.927 |
| A5 [%] | 16 | 16 |
| Z [%] | 66 | 68 |
| ZVF-outside/transverse | | |
| $Rp_{0.2}$ [MPa] | 1,170 | 1,163 |
| Rm [MPa] | 1,270 | 1,275 |
| $Rp_{0.2}$/Rm | 0.921 | 0.912 |
| A5 [%] | 15 | 16 |
| Z [%] | 53 | 63 |
| ZVF-inside/transverse | | |
| $Rp_{0.2}$ [MPa] | 1,134 | 1,144 |
| Rm [MPa] | 1,245 | 1,246 |
| $Rp_{0.2}$/Rm | 0.911 | 0.918 |
| A5 [%] | 14 | 15 |
| Z [%] | 57 | 59 |
| ZVW 320° C. - outside/longitudinal | | |
| $Rp_{0.2}$ [MPa] | 987 | 995 |
| Rm [MPa] | 1,126 | 1,144 |
| A5 [%] | 18 | 19 |
| Z [%] | 70 | 69 |
| ZVW 320° C. - inside/longitudinal | | |
| $Rp_{0.2}$ [MPa] | 1,028 | 1,025 |
| Rm [MPa] | 1,154 | 1,162 |
| A5 [%] | 17 | 20 |
| Z [%] | 71 | 69 |
| KR - RT [J] | | |
| outside/longitudinal | 89/100/97 | 97/105/109 |
| inside/longitudinal | 91/92/90 | 95/93/96 |
| outside/transverse | 86/83/83 | 99/88/92 |
| inside/transverse | 82/85/82 | 95/93/85 |
| KK - 23° C. [J] | | |
| outside/longitudinal | 64/70/68 | 69/72/79 |
| inside/longitudinal | 60/65/57 | 79/78/81 |
| outside/transverse | 56/55/54 | 76/75/75 |
| inside/transverse | 55/51/55 | 69/74/77 |

When comparing the measured values with the prior art, Table 2 shows the improvement of the material properties achieved according to the present invention.

The mechanisms that lead to the improvements of the properties of the highly heat-treated material were confirmed by extensive testing.

Figure 2:
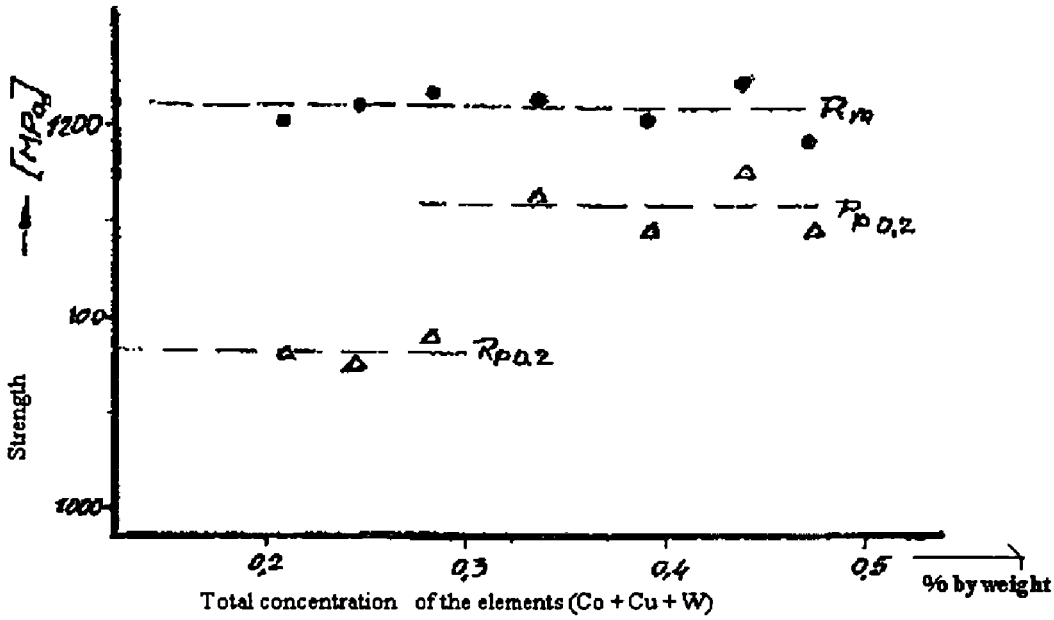
FIG. 2 shows the 0.2% yield point of a material according to the present invention as a function of the total concentration of the elements Co, Cu and W.
Figure 3:
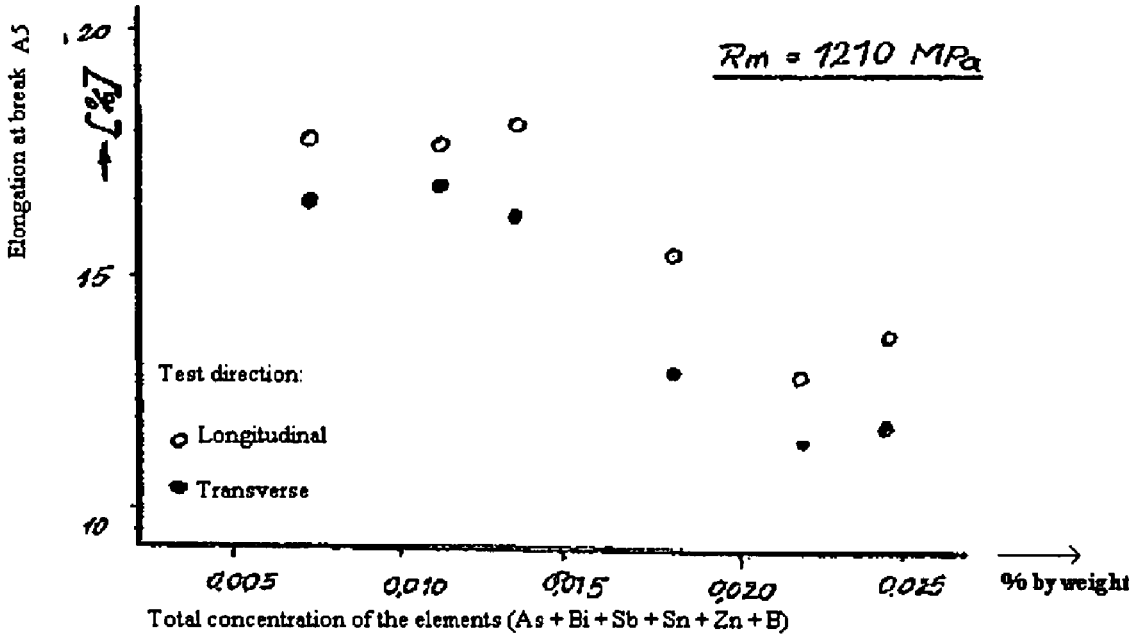
FIG. 3 shows the elongation at break of a heat-treated material according to the present invention as a function of the total concentration of the elements As, Bi, Sb, Sn, Zn and B.

In addition, FIG. 2 shows the 0.2% yield point as a function of the total concentration of the elements (Co+Cu+W). FIG. 3 shows values for the elongation at break of the heat-treated material as a function of the total concentration of the elements (As+Bi+Sb+Sn+Zn+B) contained therein.

FIG. 2 clearly illustrates a sharp increase in the 0.2% elongation values of the material with increasing value of the concentration of (Co+Cu+W).

As shown in FIG. 3, an increased concentration of (As+Bi+Sb+Sn+Zn+B) results in a reduction of the value for the elongation at break.

It is noted that the foregoing examples have been provided merely for the purpose of explanation and are in no way to be construed as limiting of the present invention. While the present invention has been described with reference to an exemplary embodiment, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

What is claimed is:

1. A component or part, wherein the component or part comprises a material for use in high-pressure components comprising an alloy which comprises, in percent by weight:

| | |
|---|---|
| C | from about 0.22 to about 0.29 |
| Cr | from about 1.1 to about 1.5 |
| Mo | from about 0.3 to about 0.6 |
| Ni | from about 3.3 to about 3.7 |
| V | from 0 to about 0.15 |
| Mn | from about 0.15 to about 0.5 |
| (Co + Cu + W) | up to about 0.31 |
| S | up to about 0.003 |
| P | up to about 0.005 |
| (S + P) | up to about 0.006 |
| O | up to about 0.0038 |
| Si | from about 0.1 to about 0.25 |
| Al | from about 0.005 to about 0.02 |
| Ca | from about 0.0001 to about 0.0008 |
| Mg | from about 0.0001 to about 0.0006 |
| (Ti + Nb + Ta + Zr + Hf) | up to about 0.01 |
| (As + Bi + Sb + Sn + Zn + B) | up to about 0.015 |
| (N + H) | up to about 0.01, |
| a balance comprising iron; | |

and wherein the component or part is heat treated to a tensile strength Rm of the material at room temperature of greater than about 1100 N/mm$^2$, has a 0.2% yield point $Rp_{0.2}$ at room temperature of greater than about 1000 N/mm$^2$ and a 0.2% yield point $Rp_{0.2}$ at 320° C. of greater than about 880 N/mm$^2$, and shows mechanical properties measured in longitudinal direction/transverse direction of:

| | |
|---|---|
| Elongation at break A5 | >about 16%/>about 14% |
| Elongation at break A4 | >about 18%/>about 16% |
| Reduction in area Z | >about 55%/>about 45% |
| Notch toughness KV (RT) | >about 80 J/>about 60 J |
| Notch toughness KV (−40° C.) | >about 50 J/>about 40 J. |

2. The component or part of claim 1, wherein the alloy comprises at least about 0.05 weight percent of vanadium.

3. The component or part of claim 1, wherein the alloy comprises not more than about 0.008 weight percent of(N+H).

4. The component or part of claim 1, wherein the alloy comprises not more than about 0.00 1 weight percent of N.

5. The component or part of claim 1, wherein the alloy comprises, in percent by weight, one or more of:

| | |
|---|---|
| Mn | not more than about 0.4 |
| (Co + Cu + W) | up to about 0.24 |
| S | up to about 0.0008 |
| (S + P) | up to about 0.005 |
| O | up to about 0.0011 |
| Si | not more than about 0.20 |
| Al | at least about 0.008 |
| Al | not more than about 0.018 |
| (Ti + Nb + Ta + Zr + Hf) | at least about 0.001 |
| (Ti + Nb + Ta + Zr + Hf) | not more than 0.008 |
| (As + Bi + Sb + Sn + Zn + B) | up to about 0.010 |
| (N + H) | up to 0.008. |

6. The component or part of claim 5, wherein the alloy comprises at least about 0.05 weight percent of vanadium.

7. The component or part of claim 5, wherein the alloy comprises not more than about 0.001 weight percent of N.

8. The component or part of claim 1, wherein the alloy comprises, in percent by weight:

| | |
|---|---|
| Mn | from 0.15 to about 0.4 |
| (Co + Cu + W) | up to about 0.24 |
| S | up to about 0.0008 |
| (S + P) | up to about 0.005 |
| O | up to about 0.0011 |
| Si | from about 0.1 to about 0.20 |
| Al | from about 0.008 to about 0.018 |
| (Ti + Nb + Ta + Zr + Hf) | from about 0.001 to about 0.008 |
| (As + Bi + Sb + Sn + Zn + B) | up to about 0.010 |
| (N + H) | up to about 0.008. |

9. The component or part of claim 8, wherein the alloy comprises at least about 0.05 weight percent of vanadium.

10. The component or part of claim 8, wherein the alloy comprises not more than about 0.001 weight percent of N.

11. The component or part of claim 1, wherein the alloy has been produced by at least one of a ladle steelmaking process, an electroslag remelting process and a vacuum arc furnace process.

12. The component or part of claim 1, wherein the material exhibits an amount of forming of greater than about 4.1-fold.

13. The component or part of claim 12, wherein the component or part has substantially isotropic mechanical properties.

14. The component or part of claim 12 wherein the component or part has a high strength and toughness at a working temperature of up to about 350° C.

15. The component or part of claim 1, wherein a ratio $Rp_{0.2}/Rm$ is smaller than about 0.94.

16. The component or part of claim 15, wherein a ratio $Rp_{0.2}/Rm$ is smaller than about 0.92.

17. The component or part of claim 1, wherein a fracture toughness of the material $J_{1C}$ is greater than about 150 kJ/m$^2$.

18. The component or part of claim 15, wherein a fracture toughness of the material $J_{1C}$ is greater than about 150 kJ/m$^2$.

19. The component or part of claim 16, wherein a fracture toughness of the material $J_{1C}$ is greater than about 150 kJ/m$^2$.

20. A component or part comprising a material that comprises an alloy, wherein the alloy comprises, in percent by weight:

| | |
|---|---|
| C | from about 0.22 to 0.29 |
| Cr | from 1.1 to about 1.5 |

-continued

| | |
|---|---|
| Mo | from about 0.3 to about 0.6 |
| Ni | from 3.3 to about 3.7 |
| V | from 0 to about 0.15 |
| Mn | from 0.15 to about 0.4 |
| (Co + Cu + W) | up to about 0.24 |
| S | up to about 0.0008 |
| P | up to about 0.005 |
| (S + P) | up to about 0.005 |
| O | up to about 0.0011 |
| Si | from about 0.1 to about 0.20 |
| Al | from about 0.008 to 0.018 |
| Ca | from about 0.0001 to 0.0005 |
| Mg | from about 0.0001 to 0.0005 |
| (Ti + Nb + Ta + Zr + Hf) | from about 0.001 to 0.008 |
| (As + Bi + Sb + Sn + Zn + B) | up to about 0.010 |
| (N + H) | up to 0.008, |
| a balance comprising iron; | |

wherein the material exhibits an amount of forming of greater than about 4.1-fold; wherein the component or part is heat treated to a tensile strength Rm of the material at room temperature of greater than about 1170 N/mm$^2$, and has a 0.2% yield point $Rp_{0.2}$ at room temperature of greater than about 1060 N/mm$^2$, and a 0.2% yield point $Rp_{0.2}$ at 320° C. of greater than about 920 N/mm$^2$; wherein a ratio $Rp_{0.2}/Rm$ is smaller than about 0.92; wherein a fracture toughness of the material $J_{1C}$ is greater than about 150 kJ/m$^2$; and wherein the component or part shows mechanical properties measured in longitudinal direction/transverse direction of:

| | |
|---|---|
| Elongation at break A5 | >about 15%/>about 14% |
| Elongation at break A4 | >about 17%/>about 16% |
| Reduction in area Z | >about 55%/>about 45% |
| Notch toughness KV (RT) | >about 80 J/>about 60 J |
| Notch toughness KV (−40° C.) | >about 50 J/>about 35 J. |

21. A component or part, wherein the component or part comprises a material for use in high-pressure components comprising an alloy which comprises, in percent by weight:

| | |
|---|---|
| C | from about 0.22 to about 0.29 |
| Cr | from about 1.1 to about 1.5 |
| Mo | from about 0.3 to about 0.6 |
| Ni | from about 3.3 to about 3.7 |
| V | from 0 to about 0.15 |
| Mn | from about 0.15 to about 0.5 |
| (Co + Cu + W) | up to about 0.31 |
| S | up to about 0.003 |
| P | up to about 0.005 |
| (S + P) | up to about 0.006 |
| O | up to about 0.0038 |
| Si | from about 0.1 to about 0.25 |
| Al | from about 0.005 to about 0.02 |
| Ca | from about 0.0001 to about 0.0008 |
| Mg | from about 0.0001 to about 0.0006 |
| (Ti + Nb + Ta + Zr + Hf) | up to about 0.01 |
| (As + Bi + Sb + Sn + Zn + B) | up to about 0.015 |
| (N + H) | up to about 0.01, |
| a balance comprising iron; | |

and wherein the component or part is heat treated to a tensile strength Rm of the material at room temperature of greater than about 1170 N/mm$^2$, has a 0.2% yield point $Rp_{0.2}$ at room temperature of greater than about 1060 N/mm$^2$ and a 0.2% yield point $Rp_{0.2}$ at 320° C. of greater than about 920 N/mm$^2$, and shows mechanical properties measured in longitudinal direction/transverse direction of:

| | |
|---|---|
| Elongation at break A5 | >about 15%/>about 14% |
| Elongation at break A4 | >about 17%/>about 16% |
| Reduction in area Z | >about 55%/>about 45% |
| Notch toughness KV (RT) | >about 80 J/>about 60 J |
| Notch toughness KV (−40° C.) | >about 50 J/>about 35 J. |

22. The component or part of claim 21, wherein the alloy comprises at least about 0.05 weight percent of vanadium.

23. The component or part of claim 21, wherein the alloy comprises not more than about 0.008 weight percent of (N+H).

24. The component or part of claim 21, wherein the alloy comprises not more than about 0.001 weight percent of N.

25. The component or part of claim 21, wherein the alloy comprises, in percent by weight, one or more of:

| | |
|---|---|
| Mn | not more than about 0.4 |
| (Co + Cu + W) | up to about 0.24 |
| S | up to about 0.0008 |
| (S + P) | up to about 0.005 |
| O | up to about 0.0011 |
| Si | not more than about 0.20 |
| Al | at least about 0.008 |
| Al | not more than about 0.018 |
| (Ti + Nb + Ta + Zr + Hf) | at least about 0.001 |
| (Ti + Nb + Ta + Zr + Hf) | not more than 0.008 |
| (As + Bi + Sb + Sn + Zn + B) | up to about 0.010 |
| (N + H) | up to 0.008. |

26. The component or part of claim 21, wherein the alloy comprises, in percent by weight:

| | |
|---|---|
| Mn | from 0.15 to about 0.4 |
| (Co + Cu + W) | up to about 0.24 |
| S | up to about 0.0008 |
| (S + P) | up to about 0.005 |
| O | up to about 0.0011 |
| Si | from about 0.1 to about 0.20 |
| Al | from about 0.008 to about 0.018 |
| (Ti + Nb + Ta + Zr + Hf) | from about 0.001 to about 0.008 |
| (As + Bi + Sb + Sn + Zn + B) | up to about 0.010 |
| (N + H) | up to about 0.008. |

27. The component or part of claim 21, wherein the alloy has been produced by at least one of a ladle steelmaking process, an electroslag remelting process and a vacuum arc furnace process.

28. The component or part of claim 21, wherein the material exhibits an amount of forming of greater than about 4.1-fold.

29. The component or part of claim 28, wherein the component or part has substantially isotropic mechanical properties.

30. The component or part of claim 28, wherein the component or part has a high strength and toughness at a working temperature of up to about 350° C.

31. The component or part of claim 21, wherein a ratio $Rp_{0.2}/Rm$ is smaller than about 0.94.

32. The component or part of claim 29, wherein a ratio $Rp_{0.2}/Rm$ is smaller than about 0.92.

33. The component or part of claim 21, wherein a fracture toughness of the material $J_{1C}$ is greater than about 150 kJ/m$^2$.

* * * * *

UNITED STATES PATENT AND TRADEMARK OFFICE

CERTIFICATE OF CORRECTION

PATENT NO. : 7,662,246 B2
APPLICATION NO. : 10/981526
DATED : February 16, 2010
INVENTOR(S) : Zand et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1292 days.

Signed and Sealed this

Thirtieth Day of November, 2010

David J. Kappos

David J. Kappos
*Director of the United States Patent and Trademark Office*